US010561247B2

(12) United States Patent
Hsiao

(10) Patent No.: US 10,561,247 B2
(45) Date of Patent: Feb. 18, 2020

(54) CHAIR BACK STRUCTURE

(71) Applicant: Chern Shing Top Co., Ltd., Zhuqi Township, Chiayi County (TW)

(72) Inventor: Hsueh-Sheng Hsiao, Zhuqi Township (TW)

(73) Assignee: Chem Shing Top Co., Ltd., Chiayi County (TW)

( * ) Notice: Subject to any disclaimer, the term of this patent is extended or adjusted under 35 U.S.C. 154(b) by 0 days.

(21) Appl. No.: 15/993,831

(22) Filed: May 31, 2018

(65) Prior Publication Data

US 2019/0365106 A1 Dec. 5, 2019

(51) Int. Cl.

| | |
|---|---|
| ***A47C 7/46*** | (2006.01) |
| ***A47C 7/00*** | (2006.01) |
| ***A47C 7/14*** | (2006.01) |

(52) U.S. Cl.

CPC ..... *A47C 7/462* (2013.01); *A47C 7/004* (2013.01); *A47C 7/14* (2013.01)

(58) Field of Classification Search

CPC ..... A47C 7/465; A47C 7/462; A47C 7/14; A47C 7/004; B60N 2/6671; B60N 2/667

USPC ..... 297/284.2, 284.7, 284.8

See application file for complete search history.

(56) References Cited

U.S. PATENT DOCUMENTS

| | | | | | |
|---|---|---|---|---|---|
| 2,692,010 | A * | 10/1954 | Christie | A47C 1/033 | 297/284.2 |
| 4,632,454 | A * | 12/1986 | Naert | B61D 33/00 | 297/284.4 |
| 6,296,308 | B1 * | 10/2001 | Cosentino | A47C 7/465 | 297/284.4 |
| 6,637,817 | B1 * | 10/2003 | Christopher | A47C 7/465 | 297/284.4 |
| 2005/0280298 | A1 * | 12/2005 | Hsiao | A47C 7/40 | 297/284.4 |
| 2006/0208553 | A1 * | 9/2006 | Ohliv | A47C 7/004 | 297/445.1 |
| 2006/0244293 | A1 * | 11/2006 | Buffa | B60N 2/6671 | 297/284.4 |

FOREIGN PATENT DOCUMENTS

| | | | | |
|---|---|---|---|---|
| DE | 102006034612 A1 * | 1/2008 | ..... | B60N 2/66 |
| FR | 2739007 A1 * | 3/1997 | ..... | A47C 7/462 |

* cited by examiner

*Primary Examiner* — Milton Nelson, Jr.
(74) *Attorney, Agent, or Firm* — Alan D. Kamrath; Karin L. Williams; Mayer & Williams PC

(57) ABSTRACT

A chair back structure includes a flexible sheet, the flexible sheet mounted on a support plate so as to adjust a curvature of a chair back by changing a curvature between two ends of the flexible sheet. A fixing segment of the flexible sheet is connected with an end of the support plate. The support plate includes two tilted abutting tabs configured to abut against with a moving segment of the flexible sheet in a sliding path, such that when the moving segment is operated to change the curvature of the flexible sheet, the moving segment slides along the two tilted abutting tabs forward or backward so as to produce a displacement, thus enhancing a bending deformation of the chair back.

18 Claims, 6 Drawing Sheets

CHAIR BACK STRUCTURE

BACKGROUND OF THE INVENTION

Field of the Invention

The present invention relates to a chair back structure in which a support plate includes two tilted abutting tabs configured to abut against a moving segment of a flexible sheet, such that when the moving segment is operated to change a curvature of a flexible sheet, the moving segment slides along the two tilted abutting tabs forward or backward so as to produce a displacement, thus enhancing a bending deformation of the chair back so as to support a waist and back of user.

Description of the Prior Art

A conventional chair back of a chair has a curvature so as to support a waist and a back of a user completely, but a variety of users have different heights and figures respectively, so the chair cannot be applicable for different heights and figures. To overcome such a defect, a flexible sheet is fixed on the chair back.

The flexible sheet contains a curvature, wherein a first end of the flexible sheet is a fixing segment connected on a support plate, and a second end of the flexible sheet is a moving segment abutting against the support plate, wherein a guide rope is coupled between the fixing segment and the moving segment and is pulled by an adjuster so as to control a length of the guide rope (or at least one spring is connected between the fixing segment and the moving segment). After changing the length of the guide rope, a distance between the moving segment and the fixing segment of the flexible sheet is changeable so as to change the curvature of the flexible sheet, thus adjusting the curvature of the chair back outside the flexible sheet so as to comply with usage requirements of the variety of users. However, the moving segment of the flexible sheet only slides on the support plate, so a displacement of the chair back pushed by the flexible sheet is slight. To solve such a problem, increasing only a size of the flexible sheet or the length of the guide rope is available, but a production cost is high.

The present invention has arisen to mitigate and/or obviate the afore-described disadvantages.

SUMMARY OF THE INVENTION

The primary objective of the present invention is to provide a chair back structure for connecting with a flexible sheet in which a support plate includes two tilted abutting tabs configured to abut against a moving segment of a flexible sheet, such that when the moving segment is operated to change a curvature of a flexible sheet, the moving segment slides along the two tilted abutting tabs forward or backward so as to produce a displacement, thus enhancing a bending deformation of the chair back so as to support a waist and back of a user.

Another objective of the present invention is to provide a chair back structure for connecting with a flexible sheet in which a slope of each of two tilted abutting tabs is tilted or arcuate, for example, when the slope of each abutting tab is tilted, a curvature of the flexible sheet is adjustable quickly, and when the curvature of the flexible sheet is arcuate, the curvature of the flexible sheet is adjustable smoothly. When the slope of each abutting tab is continuously arcuate, the chair back supports a waist and a back of the user matingly by using each abutting tab.

To achieve above-mentioned objective objectives, in a chair back structure for connecting with a flexible sheet provided by the present invention, the flexible sheet is mounted on a support plate so as to adjust a curvature of a chair back by changing a curvature between two ends of the flexible sheet, wherein a fixing segment of the flexible sheet is connected with an end of the support plate.

The support plate includes two tilted abutting tabs configured to abut against a moving segment of the flexible sheet in a sliding path, such that when the moving segment is operated to change the curvature of the flexible sheet, the moving segment slides along the two tilted abutting tabs forward or backward so as to produce a displacement, thus enhancing a bending deformation of the chair back.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
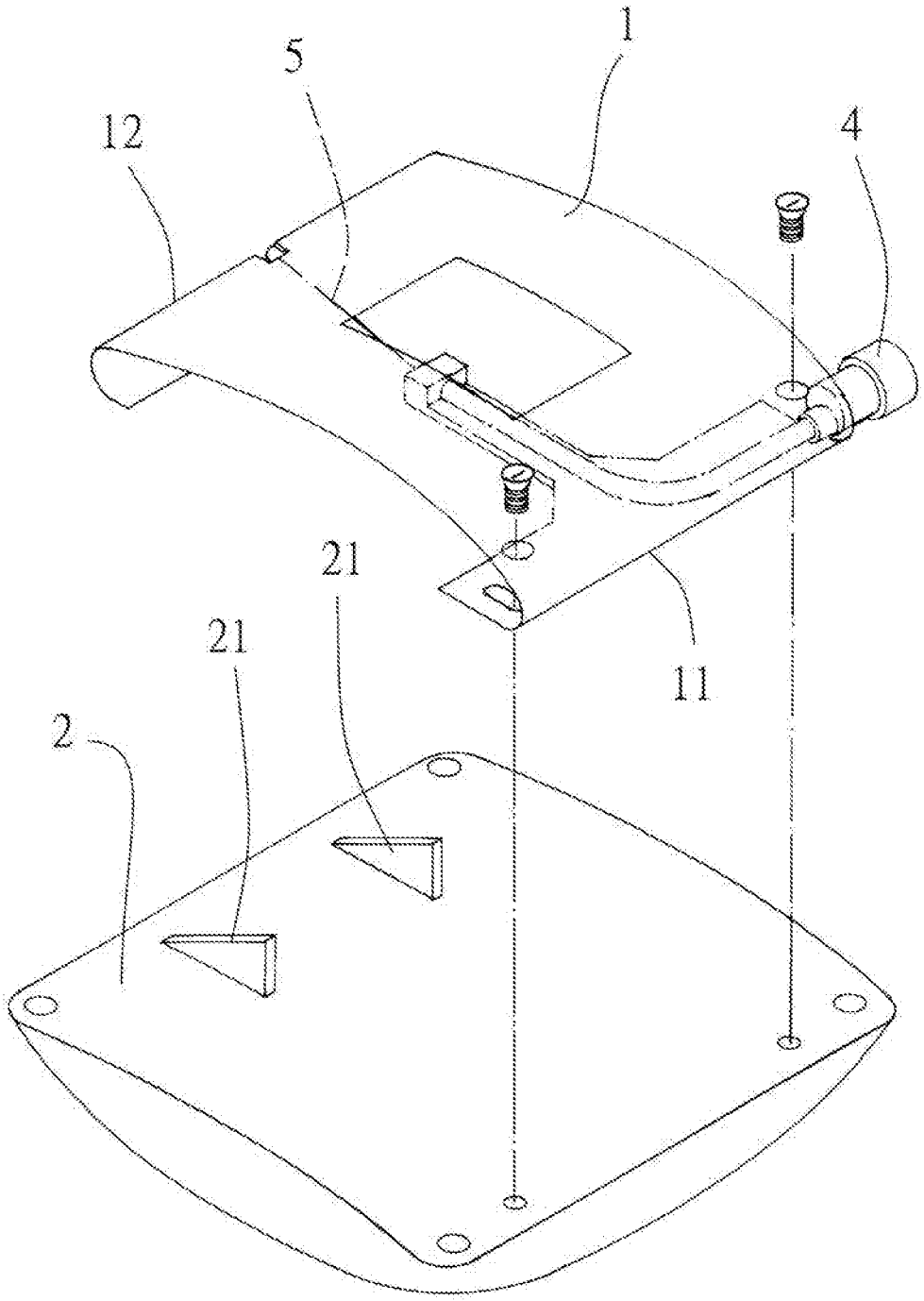
FIG. 1 is a perspective view showing the exploded components of a chair back structure for connecting with a flexible sheet according to a preferred embodiment of the present invention.
Figure 2:
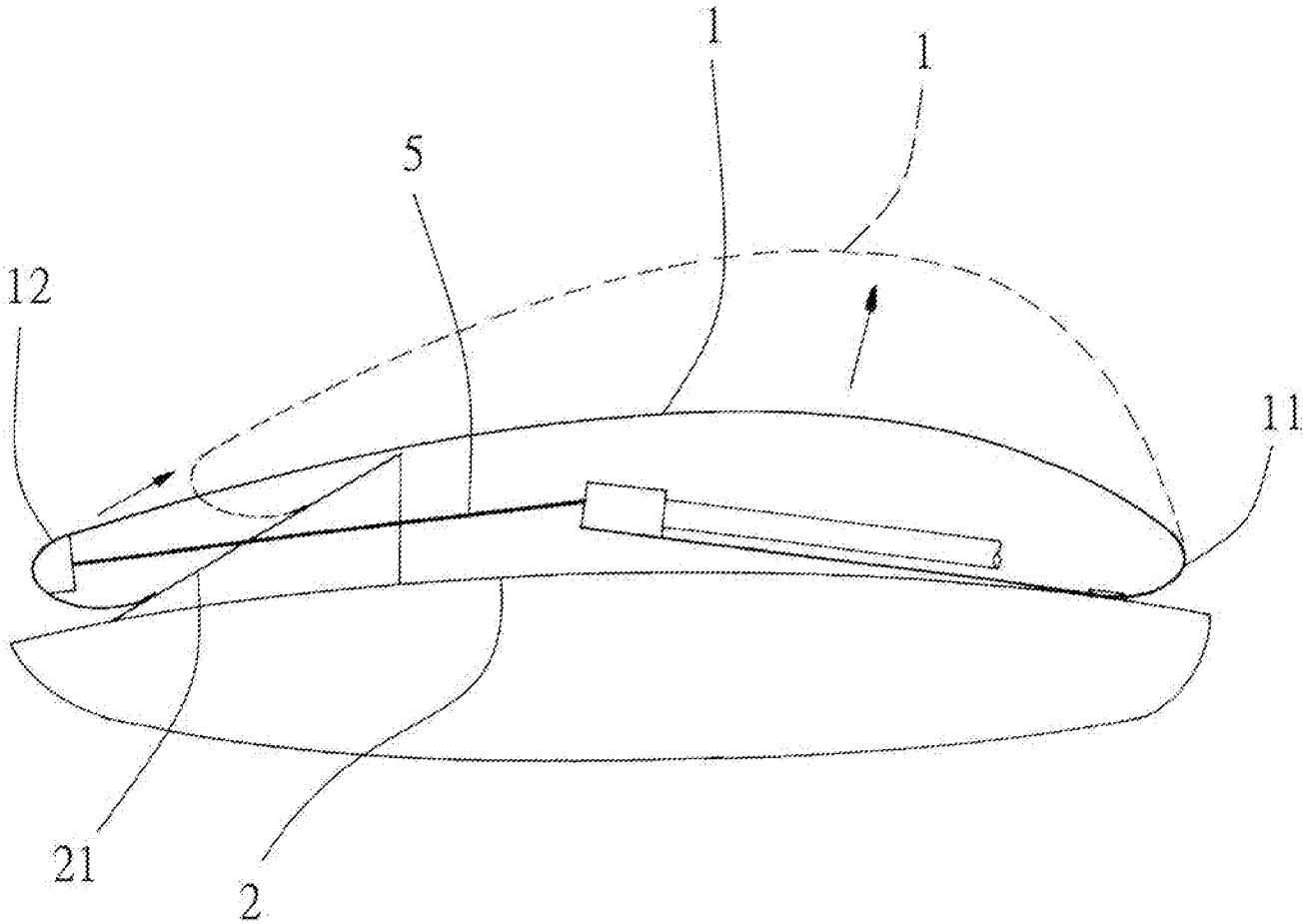
FIG. 2 is a side plan view showing the assembly of a part of the chair back structure for connecting with the flexible sheet according to the preferred embodiment of the present invention.
Figure 3:
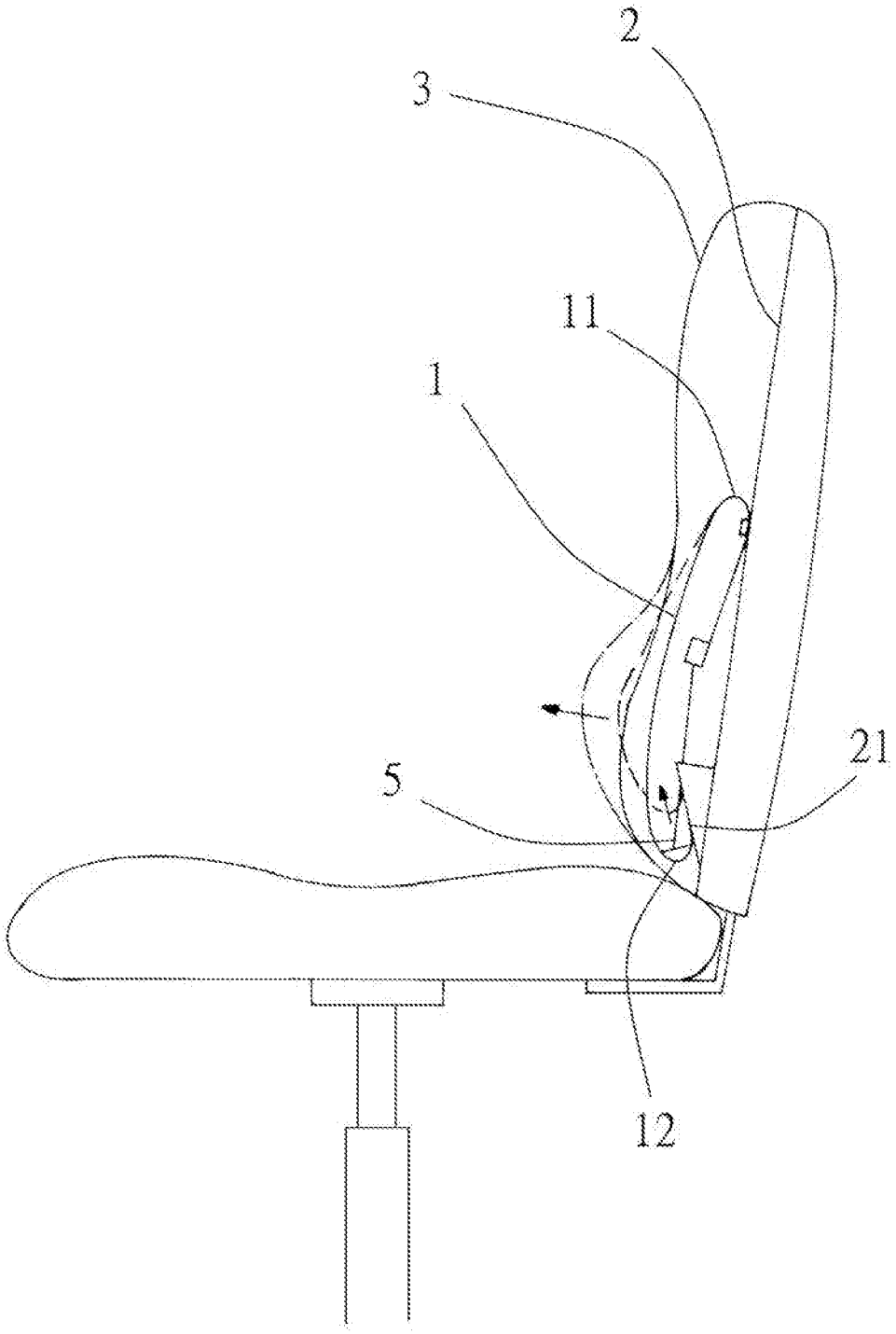
FIG. 3 is a side plan view showing the application of the chair back structure for connecting with the flexible sheet according to the preferred embodiment of the present invention.

In a chair back structure for connecting with a flexible sheet according to a preferred embodiment of the present invention, the flexible sheet 1 is mounted on a support plate 2 so as to adjust a curvature of a chair back 3 by changing a curvature between two ends of the flexible sheet 1. A fixing segment 11 of the flexible sheet 1 is connected with an end of the support plate 2, and the support plate 2 includes two tilted abutting tabs 21 configured to abut against a moving segment 12 of the flexible sheet 1 in a sliding path (stroke), as shown in FIGS. 1 and 2, such that when the moving segment 12 is operated to change the curvature of the flexible sheet 1, the moving segment 12 slides along the two tilted abutting tabs 21 forward or backward so as to produce a displacement, as illustrated in FIG. 3, thus enhancing a bending deformation of the chair back 3 (i.e., a chair back or a back cushion of a chair).

Figure 4:
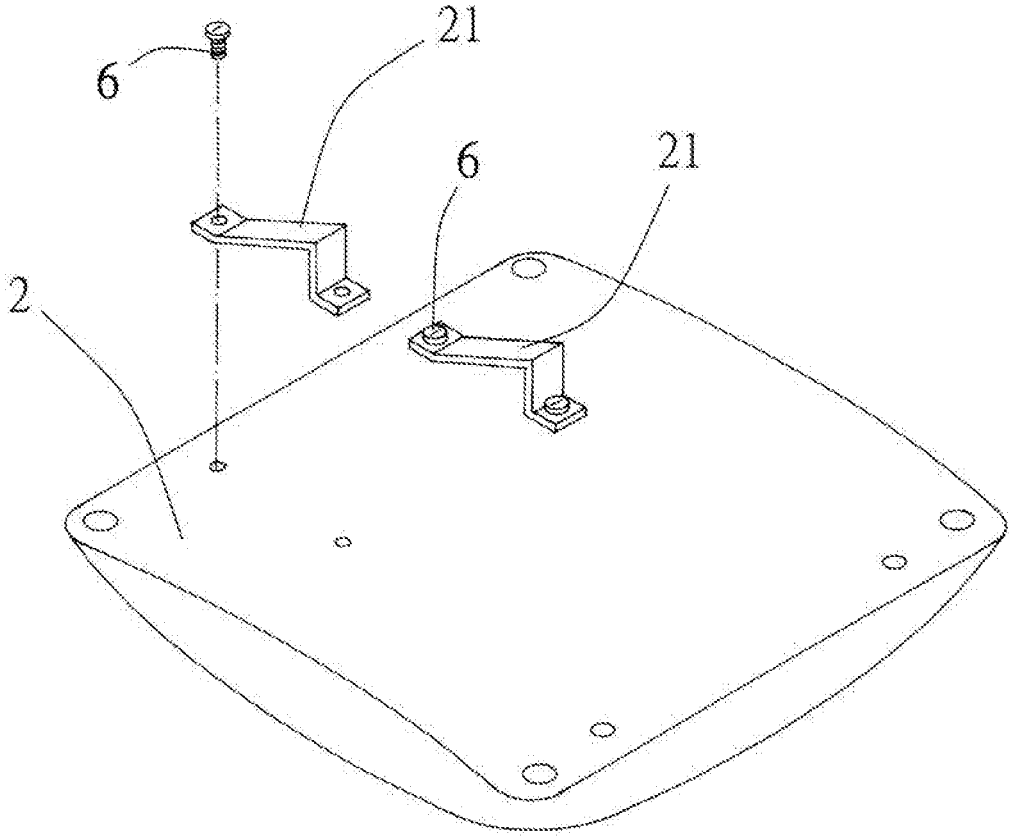
FIG. 4 is a perspective view showing the exploded components of a part of the chair back structure for connecting with the flexible sheet according to the preferred embodiment of the present invention.
Figure 5:
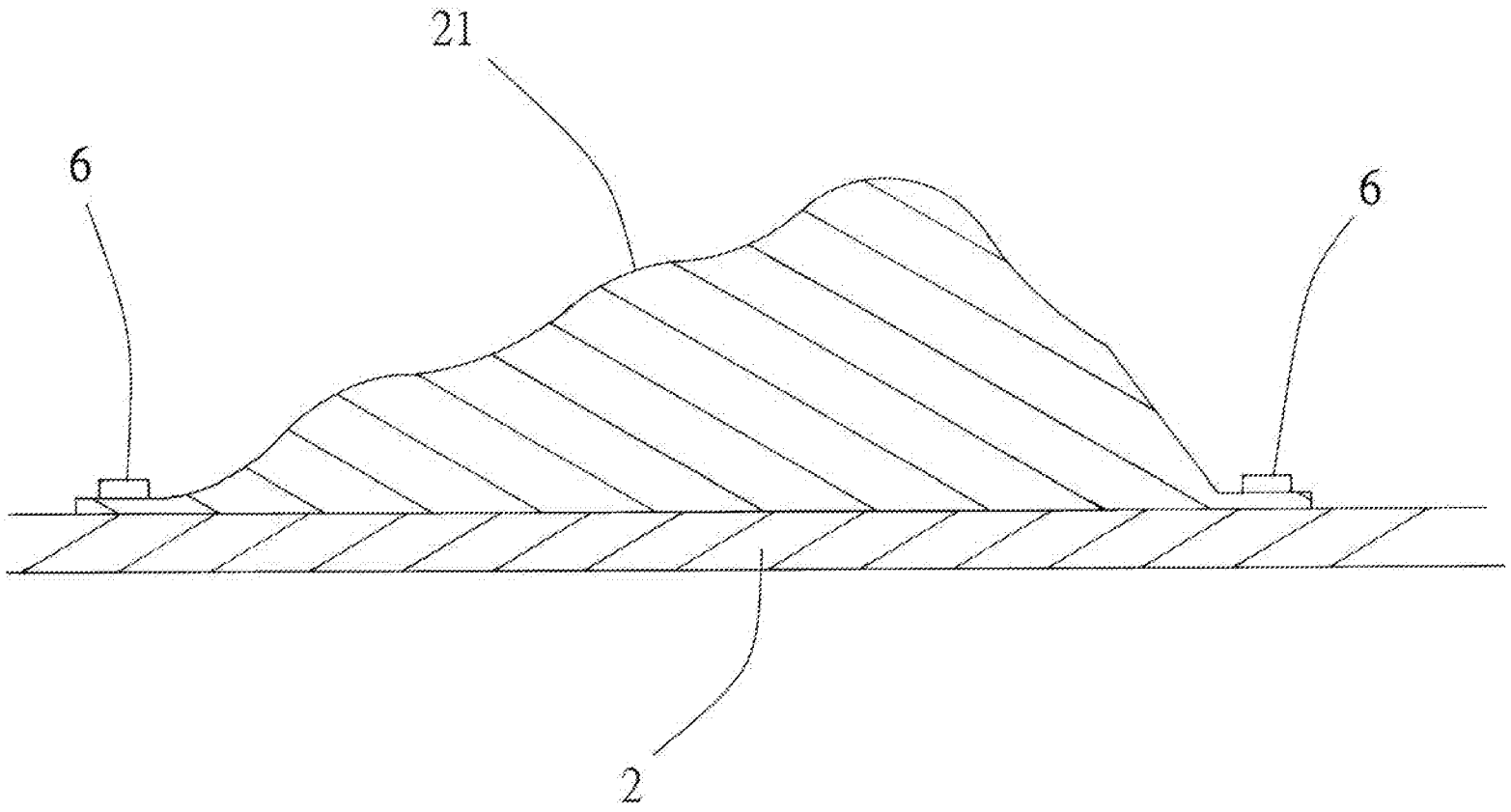
FIG. 5 is a cross sectional view showing the assembly of a part of the chair back structure for connecting with the flexible sheet according to the preferred embodiment of the present invention.

The two tilted abutting tabs 21 are integrally formed or are removably connected on the support plate 2 with at least one fixed member 6 respectively (as shown in FIG. 4, the two tilted abutting tabs 21 are removably connected on the support plate 2 with the at least one fixed member 6 respectively in a screwing, riveting or nailing manner), and a slope of each of the two tilted abutting tabs 21 is tilted or arcuate (as shown in FIG. 5), wherein the slope is a dip slope or an escarpment slope, and the slope of each abutting tab 21 is continuously arcuate, wherein each abutting tab 21 has a contact face configured to abut against the moving segment 12, and the contact face of each abutting tab 21 is linear and plane.

Figure 6:
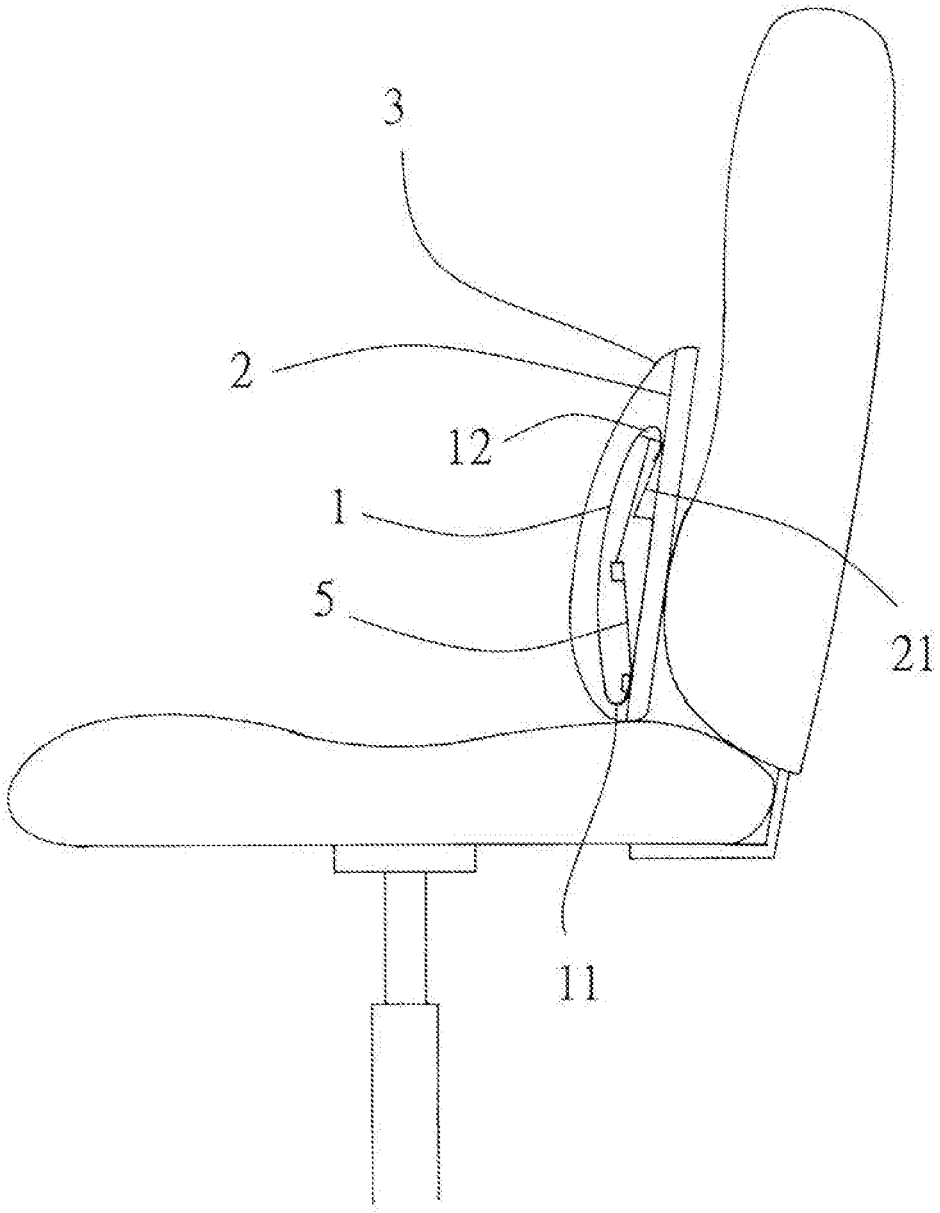
FIG. 6 is another side plan view showing the application of the chair back structure for connecting with the flexible sheet according to the preferred embodiment of the present invention.

In assembly, the fixing segment 11 of the flexible sheet 1 is connected with the end of the support plate 2 so that the moving segment 12 of the flexible sheet 1 abuts against the two tilted abutting tabs 21 (the two tilted abutting tabs 21 are located above or below the flexible sheet 1, i.e., the flexible sheet 1 is located above or below the support sheet 2 by way of the moving segment 12, as illustrated on FIG. 6), and the chair back 3 (made of shock absorption material or fabric cover. Since it is well-known art, further remarks are omitted) covers the flexible sheet 1 and the support plate 2. When user lies on the chair back 3, a length of a guide rope 5 between the fixing segment 11 and the moving segment 12 is adjusted by using an adjuster 4 so as to pull the moving segment 12 to slide on the two tilted abutting tabs 21, and the curvature of the flexible cushion 1 is changeable by adjusting a distance between the fixing segment 11 and the moving segment 12. Furthermore, when the moving segment 12 slides along the two tilted abutting tabs 21, a bending deformation of the flexible cushion 1 increases (the fixing segment and the moving segment of the flexible sheet are connected by using at least one spring, and the moving segment is located on distal ends of the two tilted abutting tabs 21 so as to move along the two tilted abutting tabs 21), hence a waist and a back of the user are supported by the chair back 3 effectively.

Preferably, the slope of each abutting tab 21 is tilted or arcuate, for example, when the slope of each abutting tab 21 is tilted, the curvature of the flexible sheet 1 is adjustable quickly, and when the curvature of the flexible sheet 1 is arcuate, the curvature of the flexible sheet 1 is adjustable smoothly. In addition, when the slope of each abutting tab 21 is continuously arcuate, the chair back 3 supports the waist and the back of the user matingly by using each abutting tab 21.

While various embodiments in accordance with the present invention have been shown and described, it is clear to those skilled in the art that further embodiments may be made without departing from the scope of the present invention.

What is claimed is:

1. A chair back structure comprising:

a flexible sheet having a moving segment at a first end and a fixing segment at a second end opposite to the first end; and a support plate having two tilted abutting tabs, wherein the fixing segment of said flexible sheet is connected to said support plate at an end opposite to the two tilted abutting tabs and is configured to adjust a curvature of a chair back by changing a curvature between the first end and the second end of the flexible sheet, and wherein the two tilted abutting tabs are configured to abut against the moving segment of the flexible sheet in a sliding path, such that when the moving segment is operated to change the curvature of the flexible sheet, the moving segment slides along the two tilted abutting tabs forward or backward so as to produce a displacement, thus enhancing a bending deformation of the chair back.

2. The chair back structure as claimed in claim 1, wherein a slope of each of the two tilted abutting tabs is a dip slope or an escarpment slope.

3. The chair back structure as claimed in claim 1, wherein a slope of each of the two tilted abutting tabs is continuously arcuate.

4. The chair back structure as claimed in claim 1, wherein a slope of each of the two tilted abutting tabs is tilted.

5. The chair back structure as claimed in claim 1, wherein a slope of each of the two tilted abutting tabs is arcuate.

6. The chair back structure as claimed in claim 1, wherein the flexible sheet further comprises an adjuster configured to pull the moving segment to slide on the two tilted abutting tabs.

7. The chair back structure as claimed in claim 6, wherein the adjuster further comprises a guide rope.

8. The chair back structure as claimed in claim 6, wherein the moving segment and the fixing segment are connected by at least one spring.

9. The chair back structure as claimed in claim 1, wherein the two tilted abutting tabs are integrally formed on the support plate.

10. The chair back structure as claimed in claim 9, wherein a slope of each of the two tilted abutting tabs is tilted.

11. The chair back structure as claimed in claim 9, wherein a slope of each of the two tilted abutting tabs is a dip slope or an escarpment slope.

12. The chair back structure as claimed in claim 9, wherein a slope of each of the two tilted abutting tabs is arcuate.

13. The chair back structure as claimed in claim 9, wherein a slope of each of the two tilted abutting tabs is continuously arcuate.

14. The chair back structure as claimed in claim 1, wherein the two tilted abutting tabs are removably connected on the support plate with at least one fixed member respectively.

15. The chair back structure as claimed in claim 14, wherein a slope of each of the two tilted abutting tabs is continuously arcuate.

16. The chair back structure as claimed in claim 14, wherein a slope of each of the two tilted abutting tabs is tilted.

17. The chair back structure as claimed in claim 14, wherein a slope of each of the two tilted abutting tabs is arcuate.

18. The chair back structure as claimed in claim 14, wherein a slope of each of the two tilted abutting tabs is a dip slope or an escarpment slope.

* * * * *